United States Patent [19]

Ganter et al.

[11] 4,262,345

[45] Apr. 14, 1981

[54] ELECTRONIC CLOCK HAVING AN ANALOG DISPLAY AND A PLURALITY OF DIGITAL FUNCTIONS

[75] Inventors: Wolfgang Ganter; Friedrich Assmus, both of Schramberg, Fed. Rep. of Germany

[73] Assignee: Gebruder Junghans GmbH, Schramberg, Fed. Rep. of Germany

[21] Appl. No.: 4,186

[22] Filed: Jan. 17, 1979

[30] Foreign Application Priority Data

Jan. 31, 1978 [DE] Fed. Rep. of Germany ..... 2804041

[51] Int. Cl.[3] ..... G04B 19/24; G04B 9/00; G04C 19/00

[52] U.S. Cl. ..... 368/29; 368/66; 368/76; 368/82

[58] Field of Search ..... 58/23 BA, 23 R, 50 R, 58/126 R, 127 R, 85.5, 4 A, 58; 368/29, 66, 76, 82

[56] References Cited

U.S. PATENT DOCUMENTS

| | | | |
|---|---|---|---|
| 3,815,351 | 6/1974 | Vovelle | 58/85.5 |
| 3,945,191 | 3/1976 | Van Berkum | 58/50 R |
| 3,948,036 | 4/1976 | Moronawa | 58/85.5 |
| 3,952,176 | 4/1976 | Holder et al. | 58/85.5 |
| 4,163,193 | 7/1979 | Kamiya | 58/23 BA |

*Primary Examiner*—Vit W. Miska

*Attorney, Agent, or Firm*—Burns, Doane, Swecker & Mathis

[57] ABSTRACT

A watch comprises an electronically controlled digital display of the month, day of the month, day of the week, or other information, in addition to a time-indicating analog display system. A single control circuit, using integrated circuit technology, controls the operation of the two display systems. A synchronizing arrangement for the synchronous control of the two display systems and a battery-condition control circuit to monitor the state of the watch battery are also included. The combination of these features provides the user with a watch which can be set and corrected in a simple manner, which insures a synchronous link between all of the data being displayed, and which provides a timely warning when a battery change is necessary.

13 Claims, 3 Drawing Figures

ELECTRONIC CLOCK HAVING AN ANALOG DISPLAY AND A PLURALITY OF DIGITAL FUNCTIONS

BACKGROUND OF THE INVENTION

The present invention relates to an electronic clock, and more particularly to a quartz crystal wrist watch having a quartz oscillator circuit and a frequency divider circuit.

British Pat. No. 1,462,898 discloses a quartz wrist watch having an analog display system for indicating the time of the day and a digital display system for the display of additional real time-related data such as the month and the day of the month. Both display systems are controlled by pulses which are derived from a frequency divider circuit. This arrangement has a disadvantage in that each display system must be individually set or corrected because a manual adjustment of the pointer-driving clockwork mechanism does not result in a simultaneous adjustment of the digital display system, so that the display of the time of the day and the read-out of the date are asynchronous.

Furthermore, this known watch does not include any controls related to the battery condition. Since one battery is used to energize two display systems, a controlling element, which is able to indicate in a suitable manner the fading of battery power, is desirable and advantageous.

OBJECT AND BRIEF SUMMARY OF THE INVENTION

It is therefore an object of the present invention to provide a clock wherein the time of the day can be displayed in an analog fashion, and additional information, such as the date, the day of the week and the like, can be displayed digitally, wherein a sychronizing link is provided between the analog display of the time of the day and the digital display of the date, day of the week or the like, and wherein a fading of battery power can be indicated.

The present invention achieves these objects by the novel combination of the features described in detail hereinafter. The combination of features proposed by the invention attains a multitude of surprising results. The synchronizing arrangement in the combination insures that the digitally displayed data will be displayed and advanced synchronously with the time of the day. This synchronous link is accomplished by deriving the pulses for the advance of the digitally displayed data directly from the cyclic motion of the pointer-driving clockwork mechanism. A forced link is established between the pointer-driving clockwork mechanism and the switching elements of the synchronizing arrangement to generate a synchronizing pulse. When these elements are arranged in a predetermined position a display-advancing pulse can be generated at a midnight-marking point in time. This timed pulse occurs whether the drive of the pointer-driving clockwork mechanism is continuous, i.e. in the normal course of the time-keeping operation of the clock, or discontinuous due to a manual correction of the analog time-display unit.

Furthermore, the clock provided by the present invention makes it possible to integrate additional functions, such as a stop watch function, an alarm function, a time-schedule function or a computer function with a relatively small increase in components which can be actuated and controlled without difficulty by the user of the watch. The data provided by these additional functions can be shown by the digital display unit in place of the date and day of the week. This additional data can be processed or stored in the display control circuit, which is designed on the basis of integrated circuit technology.

The battery-condition control circuit, another feature of the combination, insures in an advantageous manner that the bearer of the watch will be made aware at the proper time of the fading of battery power. Changing of the batteries will not cause any problems even though the time-keeping operation of the watch is interrupted, since it is only necessary to reset the analog display to correct the time when the watch starts running again. A resetting of the date, or day of the week, is not required because this data is automatically controlled by the synchronizing unit.

BRIEF DESCRIPTION OF THE DRAWINGS

The preferred embodiment of the present invention will be described in greater detail with reference to the accompanying drawing in which.

DETAILED DESCRIPTION

Figure 1:
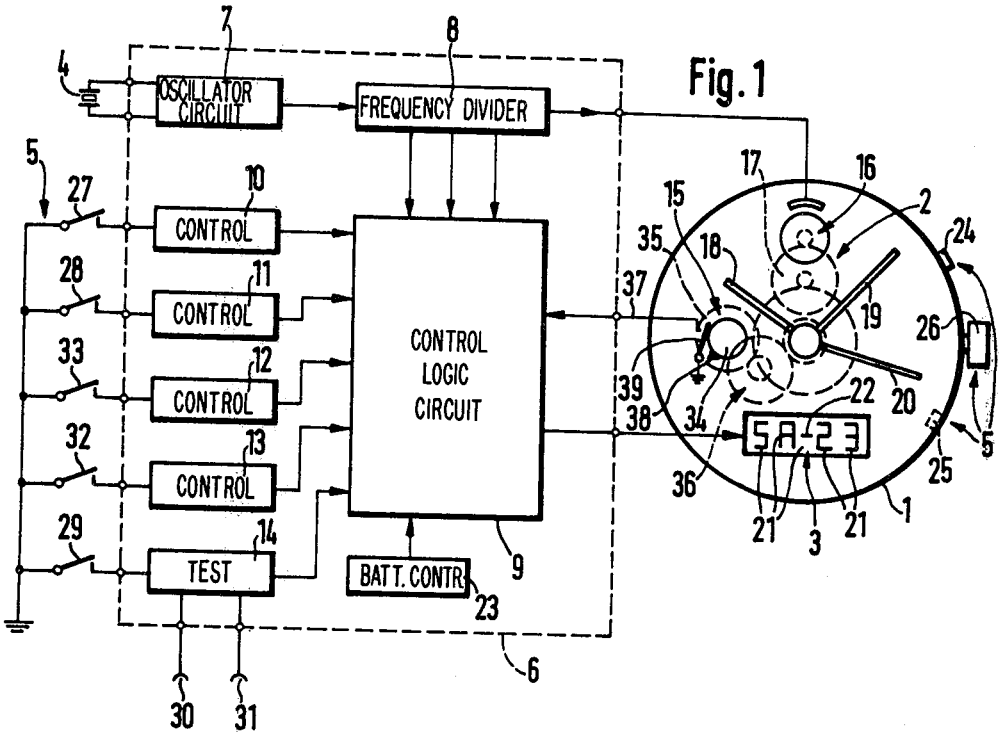
FIG. 1 is a partial block diagram illustrating a clock with a combination of features including analog and digital displays and a first embodiment of a synchronizing arrangement.

The clock illustrated in FIG. 1, for example a quartz crystal wrist watch, includes, within a casing 1, an analog display system 2, a digital read-out unit 3, a quartz oscillator 4, a display-setting unit 5, and an integrated display control circuit 6. The display control circuit 6 includes a quartz oscillator circuit 7 for control of the quartz oscillator 4 and a frequency divider circuit 8 connected in series with the oscillator circuit 7. The display control circuit 6 also includes a conventional control logic circuit 9, several display position selection and correction control circuits 10, 11, 12, 13, and a logic test circuit 14. The clock also includes a synchronizing unit 15.

The analog display system 2 comprises a pointer-driving unit including a stepping motor 16, a pointer-driving clockwork mechanism 17 which is driven by the motor 16, and an indicator system including an hour hand 18, a minute hand 19, a second hand 20 and a calibrated face (not shown). The stepping motor 16 is connected with the output terminal of the frequency divider circuit 8. The stepping motor 16 is controlled by output pulses having a frequency of 1 cycle per second, so that the second hand 20 is advanced by means of the clockwork mechanism 17 once each second.

The digital read-out system 3 can be a fluid crystal display unit having at least five display positions 21 which are arranged adjacent one another. Each display position has a segmented display with at least seven segments. It is also within the realm of the present invention to use an electrochromatic, luminous-diode or similar type of display in place of the fluid-crystal display unit. The digital display positions 21, together with an optical separator 22 in the form of a dash or a colon, will allow the selective digital display of the following real time related information: date and month, day of the week in a preselected language or one of a number of other selectively available languages, date of the month, chronographic displays, zero time count, elapsed time, stopped time, etc. It is also feasible, by structuring the display control unit 6 in an appropriate known manner, to utilize the display positions 21 for the display of additional functions such as specific points in time to be remembered, appointments to keep, specially computed figures and the like. Also integrated in the display control circuit 6 is a battery condition control circuit 23 which generates a signal when the battery voltage drops below a certain, predetermined level. The signal generated by the battery contol circuit 23 is transmitted to one of the display positions 21 where it causes one or more of the display segments to flash intermittently. It is also possible to inform the user of the watch of low battery output potential by means of some other signal, such as an audible signal, for example.

The control pulses for the operation of the fluid-crystal display unit 3 are derived from the frequency divider circuit 8 and fed by means of control channels into the control logic circuit 9 where they are processed and transmitted to the individual display positions 21. The display setting unit 5 includes several switches which can be manually actuated by means of a plurality of manually operated push buttons 24, 25, and a rotatable spindle 26 which can be set to various positions. The switches and spindle interact with display position selection and correction control circuits 10, 11, 12, 13 and with the logic test circuit 14 to adjust and test the operation of the display unit segments.

The adjusting spindle 26 can be radially pulled from its normal illustrated position to an outer position. Pulling the spindle 26 to the outer position closes a reset contact 27 which is connected with the correction control circuit 10. The closing of this reset contact 27 suppresses the transmission of pulses from the freqency divider circuit 8 to the stepping motor 16 and the fluid-crystal display unit 3 while information is being entered into the display control circuit 6. When the spindle 26 is in its outer position, it is also possible to correct the positions of the minute hand 19 and the hour hand 18 in a conventional manner by turning the adjusting spindle 26. When the adjusting spindle 26 is returned to its normal position, pulses will again be fed into the stepping motor 16 and the previously suppressed digital read-out will again appear at the fluid crystal display unit 3.

The adjusting spindle 26 also interacts with a selection switch 28 and a testing switch 29 of the display setting unit 5. The testing switch 29 can be closed by turning the adjusting spindle 26 while in its normal position. This switch 29 is connected to the logic test circuit 14 and serves in conjunction with this test circuit to check the function of the display control circuit 6 and the control logic 9. The tested circuits can be connected to a measuring device (not shown) by way of test input leads 30 and 31.

The selection switch 28 can be closed by pushing the adjusting spindle 26 from its normal position to an inside position. The closing of the selection switch 28, which is connected with the display-selection switching circuit 11, results in suppression of the day of the week and date read-out on the fluid crystal display unit 3 and a different piece of information, such as the zero display of the elapsed time function, can be displayed. A repeated pressing of the adjusting spindle 26 would restore the date and day of the week read-out.

The elapsed time function is triggered by a first push button 24 which, when actuated, closes a trip-switch 32. This latter switch 32 is connected with a chronographic control circuit 13. The first actuation of the push button 24 causes the initiation of the timing operation, with running time being indicated in minutes, seconds and fractions of a second by the individual display digits 21 of the fluid crystal display unit 3. A second pressing of the push button 24 stops the timing operation and the elapsed time is then shown on the fluid crystal display unit 3. A third pressing of the push button 24 will reset the counters and the memory of the chronographic control circuit 13 and the fluid crystal display unit, wherein all numeral display digits 21 will then read zero.

A second push button 24 interacts with a display selection switch 33 which is connected with the display-selection and correction control circuit 12. Beginning with a read-out of the day of the week and the date, a first brief pressing of the push button 25 will cause the suppression of this read-out and switches the display to a numerical read-out of the month. If this first pressing is maintained for a relatively long period of time, the new display, i.e. read-out of the month, will be automatically adjusted at a fixed correction frequency, for example 1 cps, derived from the frequency divider circuit 8.

A second, brief pressing of the push button 25 results in suppression of the numerical display of the month and switches the display to a fully numerical read-out of the date, showing month and day of the month, for example 12–23. If this second pressing is maintained for a period of time, the numerical day, shown by this new read-out, is then automatically corrected by a fixed correction frequency, for example 1 cps, again derived from the frequency divider circuit 8.

A third, brief pressing of the push button 25 results in suppression of the numerical read-out of the date and switches the display to abbreviations of the languages which can be used for the days of the week, for example "DT" for German, "FR" for French, "EN" for English, "IT" for Italian, "SP" for Spanish and "PO" for Portuguese. If this third pressing of the push button 25 is maintained for a period of time, the display unit 3 will automatically cycle through the abbreviations of the languages which can be used for the days of the week at a frequency derived from the frequency divider circuit 8, until the button 25 is released. A fourth, brief pressing of the push button 25 will then cause the display to switch from the previous language read-out to a read-out of the day of the week and the date of the month, with the day of the week appearing in the abbreviation of the selected language. If this fourth pressing of the push button 25 is maintained for a relatively long period of time, the read-out of the day of the week is corrected at the fixed frequency derived from the frequency divider circuit 8, until the correct day of the week appears on the fluid crystal display unit 3.

A fifth, brief pressing of the push button 25 results in a return to the original read-out, showing the day of the week in a preselected language together with the day of the month.

The synchronizing unit 15 has its input terminal connected to the pointer-driving clockwork mechanism 17 and its output terminal connected to the display control circuit 6. The synchronizing unit 15 is designed such that synchronizing pulses derived from the cyclic motion of the clockwork 17 can be fed into the display control circuit 6, preferably at a rate of one pulse per 24 hours, to advance the digital read-outs for the month, day of the month and day of the week.

FIG. 1 illustrates a first embodiment of a synchronizing unit 15 having a switching wheel 34 and a pinion 35 which is mated with and driven by the pointer-driving clockwork mechanism 17 by means of a step-down gearing 36. This step-down gearing 36 is proportioned in such a manner that the switching wheel 34 will perform one single rotation per day. The synchronization unit 15 also contains a contact arrangement which closes at least one switching path 37 leading to the display control circuit 6, for the purpose of generating a display-advancing pulse.

The switching wheel 34 carries a radially protruding pin 38 which interacts with the movable contact of a switch 39 connected to one pole of a battery. In the illustrated embodiment, the negative pole of the battery is connected to the movable contact and forms an integral part of the contact arrangement. The pin 38 is located on the switching wheel 34 in a position relative to the pointer-driving clockwork mechanism 17 such that the switch 39 will be closed for a short period of time in the course of continuous operation of the clock. This closure takes place once per day, preferably at midnight, to thereby generate a switching pulse. This switching pulse is fed into the display control circuit 6, and is transformed into a display-advancing pulse which is then transmitted to the fluid crystal display unit 3, with the result that the date is advanced each time by one unit.

Figure 2:
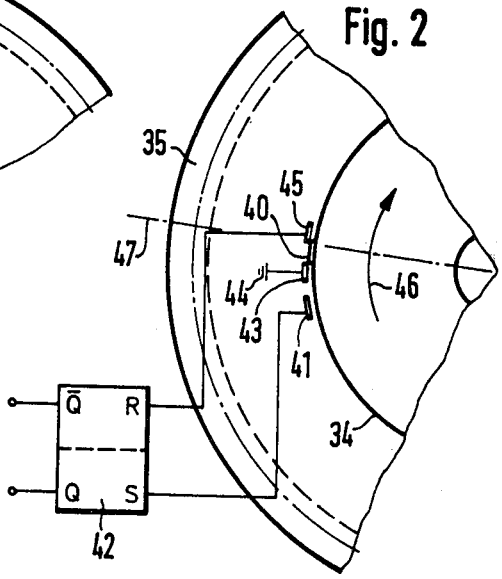
FIG. 2 illustrates a second embodiment of a synchronizing arrangement in partial schematic form.

FIG. 2 illustrates a second embodiment of the synchronizing unit 15. The switching wheel 34 is made of insulative material and carries at its circumference a contact surface 40, which serves as a contact bridge. The contact arrangement of the synchronizing unit 15 comprises three mating contacts 41, 43, 45. The first mating contact 41 is connected to the set input terminal S of an RS flip-flop 42. The flip-flop 42 is integrated in the display control unit 6. The second central contact 43 is connected to the negative pole 44 of a battery. The third mating contact 45 is connected to the reset input terminal R of the RS flip-flop 42. These three mating contacts 41, 43, and 45 co-act in pairs with the contact surface 40 of the switching wheel 34 to generate two time-staggered set and reset pulses which are fed to the RS flip-flop 42.

The contact surface 40 is arranged on the switching wheel 34 in a manner relative to the pointer-driving clockwork mechanism such that, shortly before the generation of a display-setting pulse, the two mating contacts 41 and 43 will be connected with each other by way of the contact surface 40 and thereby set the RS flip-flop 42. When the switching wheel 34 continues to rotate in the direction of the arrow 46, the two mating contacts 43 and 45 will be connected with each other by way of the contact surface 40 at the precise moment required for the generation of the display-setting pulse, e.g. midnight. The location of the leading edge of the contact surface 40 at this point in time is marked by a dot and dash line 47 in FIG. 2. A switching pulse is thereby produced to be fed into the reset input terminal R of the RS flip-flop 42 to reset the flip-flop. The signal which is present at the false output terminal $\overline{Q}$ of the RS flip-flop 42 will then be presented to the circuitry of the display control circuit 6 in the form of a display-setting pulse, to thereby advance the day of the week and the date shown on the fluid crystal display unit 3 by one unit.

It will be apparent from the preceeding description that the digitally displayed values are advanced synchronously with the displayed time of day. This advancement applies to the continuous operation of the clock as well as to the case of a correction of the pointer position in a forward direction beyond the midnight switching time point.

Figure 3:
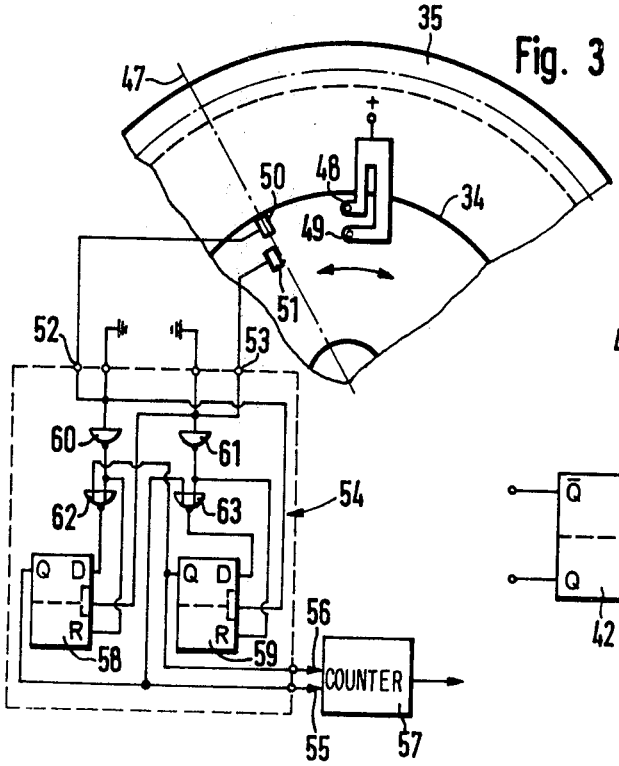
FIG. 3 illustrates another embodiment of a synchronizing arrangement in partial schematic form.

The synchronizing arrangement illustrated in FIG. 3 allows the correction of the displayed clock time to take place in a forward or a reverse direction by generating either a forward or a reverse display-setting pulse in dependence upon the direction of the correction motion of the minute hand 19 beyond the switching time point. The synchronizing arrangement of this embodiment includes two leaf spring contacts 48 and 49 which are arranged side-by-side and which are connected with the positive pole of the battery. The arrangement further includes two mating contacts 50, 51 which are arranged on the switching wheel 34. These two mating contacts 50, 51 are slightly offset relative to each other when viewed in the direction of rotation of the switching wheel 34.

Each of the two mating contact surfaces 50 and 51 respectively is further connected with one input terminal 52 and 53, respectively, of a reversible control logic 54. This control logic 54 has two output terminals. The first output terminal is connected to the UP input terminal 55 and the second output terminal is connected to the DOWN input terminal 56 of an UP-DOWN counting unit 57. The counting unit 57 controls the advance of the digital read-out. The reversible control logic 54 includes two flip-flop units 58 and 59 which are controlled by a logic consisting of logic gates 60, 61, 62 and 63. The reversible control logic 54 and the UP-DOWN counting unit 57 are components of, and are integrated in, the display control circuit 6.

Due to the lateral stagger of the mating contact surfaces 50 and 51 on the switching wheel 34, and in conjunction with the two spring leaf contacts 48 and 49, two time-staggered pulses are generated when the midnight switching time point is crossed. The relative phase shift of these two pulses is evaluated in the reversible control logic 54 and either a forward or a backward counting pulse will be fed into the UP-DOWN counting unit 57, depending on the relative position of the pulses.

This arrangement insures that the analog display of the time of the day and the digital read-out showing the day of the week and the date will remain synchronous with each other not only in the course of the normal time-keeping operation of the clock or in the case of a forward correction of the analog display, but also in the case of a reverse correction of the analog display beyond the midnight switching time point. If a reverse direction correction movement of the minute hand 19 crosses the switching time point, the reversible control logic 54 will recognize such movement as being a reverse direction correction, and a counting pulse will be fed into the DOWN input terminal 56 of the UP-DOWN counting unit 57. This will result in a set back by one unit of the day of the week and the date shown on the fluid crystal display unit 3.

The synchronous coupling of the analog time display with the digital read-out of the date and the day of the week is accomplished by the synchronizing arrangement of the present invention with the use of relatively simple means and in an advantageous manner. Furthermore, the combination of an analog display system with a digital read-out system, an integrated display control circuit, a synchronizing unit and a battery-condition control circuit provides a watch which, due to its distinct separation of the individual displays, allows its bearer to read all data clearly and free of errors, while insuring a simple handling and monitoring of functions in spite of their variety.

The present invention may be embodied in other sspecific forms without departing from the spirit or essential characteristics thereof. The presently disclosed embodiments are therefore considered in all respects as illustrative and not restrictive. The scope of the invention is indicated by the appended claims rather than the foregoing description, and all changes which come within the meaning and range of equivalency of the claims are therefore intended to be embraced therein.

What is claimed is:

1. An electronic clock, comprising:

a cyclically operating analog display system for indicating the time of day;

an electronically controlled digital display system for selectively indicating a plurality of other real time related data;

an integrated display control circuit including an oscillator circuit for providing timing pulses and a frequency divider circuit for converting said timing pulses into control pulses having a predetermined frequency for controlling said analog and digital display systems;

a control unit having a logic element, a switching wheel driven by the cyclically operating analog display system, a contact surface on the circumference of said switching wheel, a first mating contact connected to one input terminal of said logic element, a second mating contact connected with a reference voltage source, and a third mating contact connected to another input terminal of said logic element wherein said mating contacts coact in pairs with said contact surface of said switching wheel to generate two time staggered pulses which are fed into the logic element to selectively actuate said logic element to generate an actuating pulse which is transmitted to the display control circuit to cause a stepwise change in the digital indication of the real time related data; and a battery-condition test circuit for actuating the digital display system to indicate when the output voltage from a power supply battery drops below a predetermined level.

2. An electronic clock as defined in claim 1 wherein the analog display system comprises a stepping motor responsive to the output signal from the frequency divider circuit, a pointer-driving clockwork mechanism driven by said motor, and an indicator system driven by said clockwork mechanism.

3. An electronic clock as defined in claim 1 wherein the digital display system includes a fluid-crystal display unit with at least five display positions, each display position having a segmented display unit with at least seven segments.

4. An electronic clock as defined in claim 1 wherein the oscillator circuit and the frequency divider circuit are integrated components of the display control circuit, further wherein the display control circuit comprises a control logic circuit, a correction control circuit, a display-selection switching circuit, a display selection and correction control circuit, a chronographic control circuit, and a logic test circuit which are all arranged within one IC-chip.

5. An electronic clock as defined in claim 4, further including a display setting unit which comprises a plurality of switches, and a first manually operated push button, a second manually operated push button and an adjusting spindle which can be set at various positions for controlling actuation of said plurality of switches.

6. An electronic clock as defined in claim 5, wherein a first switch of the display setting unit is connected with the correction control circuit, a second switch of the display setting unit is connected with the display-selection switching circuit, and a third switch of the display setting unit is connected with the logic test circuit, further wherein these switches are actuated by movement of the adjusting spindle and the information displayed on the analog display system is corrected by means of the adjusting spindle.

7. An electronic clock as defined in claim 5, wherein the display setting unit further includes a fourth switch which is connected with the chronographic control circuit and which is actuated by the first manually operated push button, and a fifth switch which is connected with the display-selection and correction control circuit and is actuated by the second manually operated push button.

8. An electronic clock as defined in claim 4, wherein the output terminals of the correction control circuit, the display-selection switching circuit, the display-selection and correction control circuit, the chronographic control circuit, the logic test circuit, the battery-condition control circuit, and the frequency divider circuit are connected to the control logic circuit, and further wherein output terminals of the control logic circuit are connected to the digital display system.

9. An electronic clock as defined in claim 1 wherein the contact elements of said pair of contacts are located relative to the pointer-driving clockwork mechanism such that actuating pulses for the advancement of the digitally displayed data are generated at a midnight marking point in time.

10. An electronic clock as defined in claim 1, wherein said logic element is a flip-flop with the first of said time-staggered pulses acting to set said flip-flop and the second of said pulses acting to reset said flip-flop.

11. The electronic clock of claim 1 wherein said switching wheel is made of insulative material.

12. An electronic clock, comprising:

a cyclically operating analog display system indicating the time of day;

an electronically controlled digital display system for selectively indicating a plurality of other real time related data;

an integrated display control circuit including an oscillator circuit for providing timing pulses and a frequency divider circuit for converting said timing pulses into control pulses having a predetermined frequency for controlling said analog and digital display systems;

a control unit having a switching wheel driven by the cyclically operating analog display system, a pair of contacts, two mating contact surfaces disposed on the switching wheel slightly staggered relative to each other, and a reversible control logic having two input terminals connected to said two mating contact surfaces, wherein rotation of said switching wheel produces contact respectively between said pairs of contacts and said mating contact surfaces to generate two time staggered pulses having a relative phase shift dependent upon the direction of rotation, which are processed in the reversible control logic to thereby generate an actuating pulse which is transmitted to the display control circuit to produce a stepwise change in the digital indication of the real time related data; and a battery-condition test circuit for actuating the digital display system to provide an indication when the output voltage from a power supply battery drops below a predetermined level.

13. The electronic clock of claim 12 wherein said reversible control logic has two output terminals respectively connected to two input terminals of a reversible counting unit for controlling the digital display unit and wherein said reversible control logic is responsive to the relative phase shift between pulses to selectively actuate the reversible counting unit to count in a forward or a backward direction.

* * * * *